United States Patent [19]

Teague, Jr.

[11] 3,934,572

[45] Jan. 27, 1976

[54] INFRARED SPACE HEATER

[76] Inventor: Walter Dorwin Teague, Jr., Tweed Blvd., Nyack, N.Y. 10960

[22] Filed: Apr. 2, 1973

[21] Appl. No.: 347,220

[52] U.S. Cl. ..... 126/92 B; 126/85 B; 431/215

[51] Int. Cl.[2] ..... F24C 3/04

[58] Field of Search ..... 126/85 B, 312, 91, 92 B, 126/92 C, 92 AC; 431/215, 216, 217, 161

[56] References Cited

UNITED STATES PATENTS

| | | | |
|---|---|---|---|
| 1,805,781 | 5/1931 | Moreton | 126/92 B |
| 2,530,675 | 11/1950 | Bennett | 431/213 |
| 2,764,972 | 10/1956 | Ryder | 126/85 B |
| 2,818,060 | 12/1957 | Field | 126/85 B |
| 3,202,205 | 8/1965 | Webster | 126/92 R |
| 3,499,432 | 3/1970 | Hannebaum | 126/120 |
| 3,614,948 | 10/1971 | Jackson et al | 126/85 B |
| 3,614,949 | 10/1971 | Goodgion | 126/85 B |
| 3,662,735 | 5/1972 | Jackson | 126/85 B |
| 3,741,194 | 6/1973 | Herron | 126/85 B |
| 3,815,572 | 6/1974 | Wolfe | 126/85 B X |

*Primary Examiner*—John J. Camby
*Assistant Examiner*—William E. Tapolcai, Jr.
*Attorney, Agent, or Firm*—Harold L. Stults

[57] ABSTRACT

A gas-fired, infrared space-heater which is compact and has "sealed combustion", and which is particularly suited for small recreational vehicles and for boating and camping installations. A vent for the products of combustion is provided through a flue which is surrounded by a concentric fresh air inlet pipe which provides a heat-exchange relationship to heat the incoming air by the gases being exhausted.

17 Claims, 2 Drawing Figures

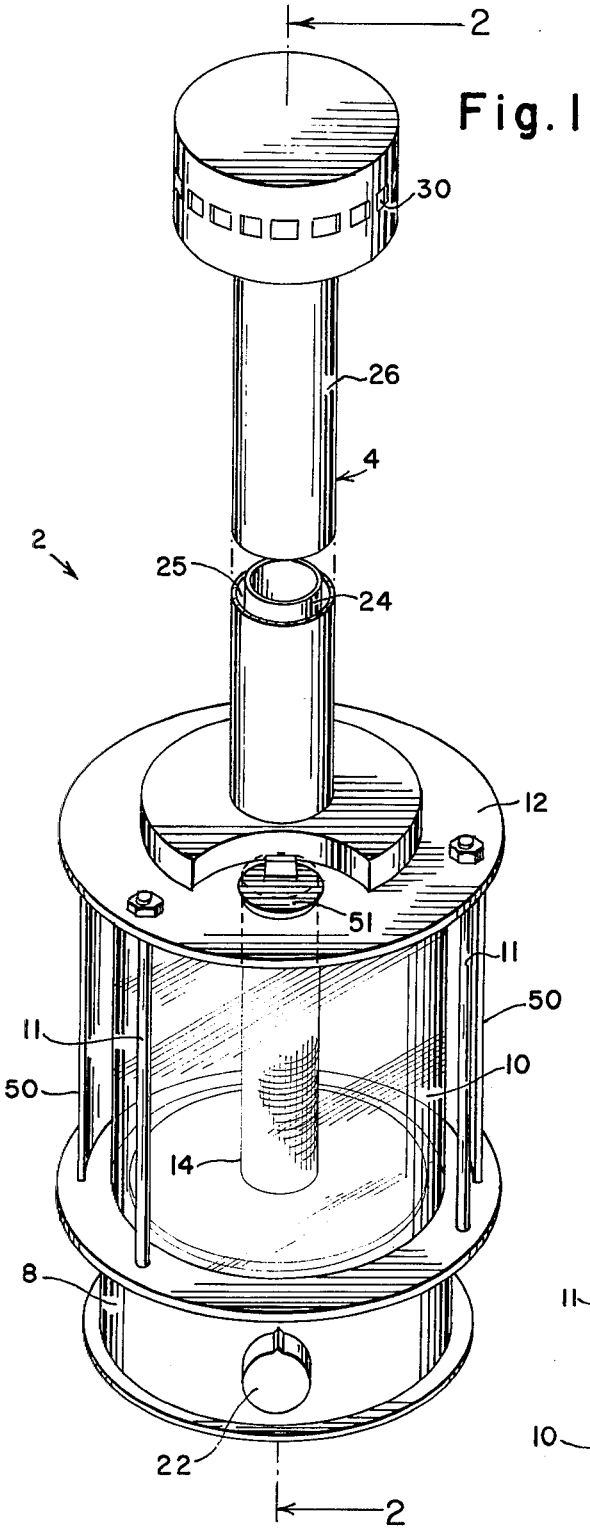
Fig. 1
Fig. 2
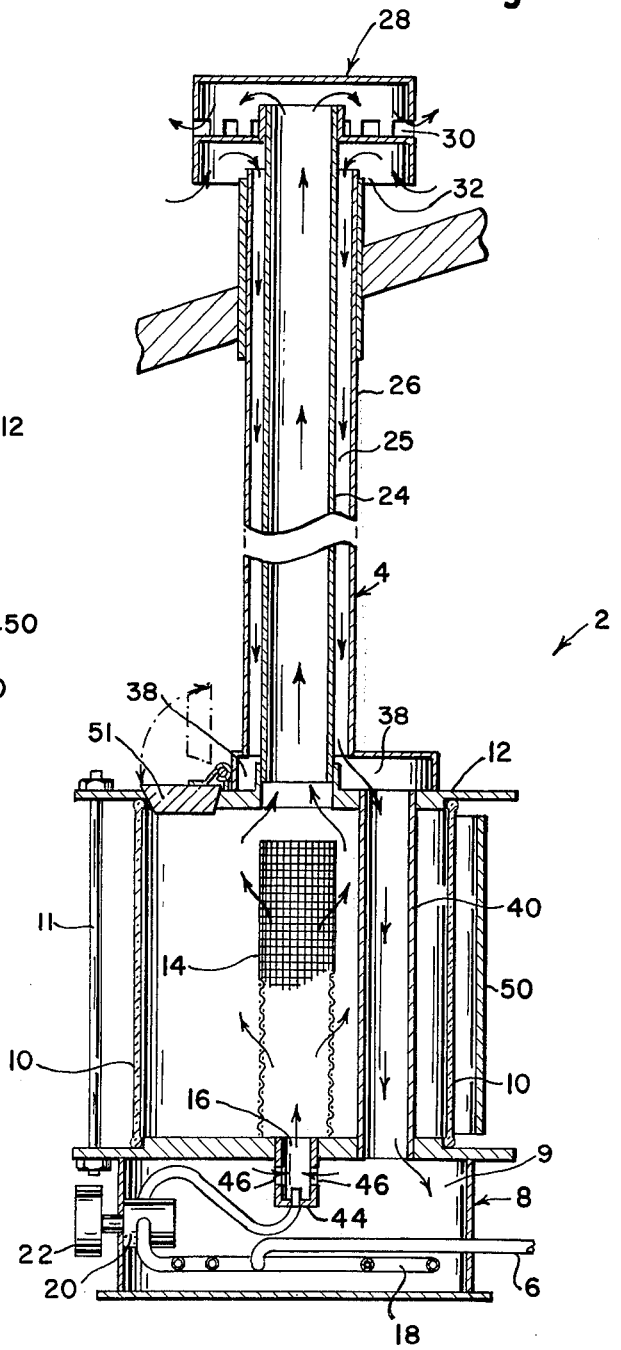

INFRARED SPACE HEATER

This invention relates to infrared space-heaters, and particularly to compact gas-fired heaters for uses such as in recreational vehicles, boats and camping installations.

An object of this invention is to provide improved compact space heaters. A further object is to provide sealed combustion infrared heaters which are compact in construction, light in weight and adaptable to various conditions of operation and use. A further object is to provide a compact space heater with a high percentage of infrared output so as to provide quiet and instantaneous heat distribution within a confined space without requiring a circulating fan or any moving parts. A further object is to provide for the above with heaters which are safe and efficient in operation and which overcome difficulties encountered with similar constructions in the past. These and other objects will be in part obvious and in part pointed out below.

IN THE DRAWINGS:

FIG. 1 is a perspective view of one embodiment of the invention; and

FIG. 2 is a vertical sectional view of the heater taken along line 2—2 of FIG. 1.

Referring to FIG. 2 of the drawings, a space heater 2 has a flue construction 4, and it receives fuel gas through a line 6. Heater 2 has a base portion 8 which forms a plenum chamber 9 for fresh air from which the air passes into the burner. A cylindrical heat-resistant infrared transparent glass chimney 10 rests upon base 8 and is closed at the top by a top construction 12. Base 8 and top construction 12 are of greater diameter than chimney 10, and three tie-rods 11 extend downwardly through the top construction and into the base, thus supporting the top construction and clamping the chimney in place. The base, chimney, top construction and flue construction have a common axis, and positioned concentrically within the flue is a cylindrical infrared burner 14. Burner 14 has a closed top and it receives a mixture of air and gas through a central bottom port 16. Gas is supplied from line 6 through a spiral metal heat-exchange tube 18 and a control valve 20 having a knob 22.

Flue construction 4 is formed by an inner flue 24 and an outer flue 26 having an annular passageway 25 therebetween for the incoming fresh air. The products of combustion pass radially outwardly through the cylindrical burner wall and thence inwardly and upwardly through flue 24. The top of the flue construction is protected by a vent unit 28 which has exhaust ports 30 for flue 24. Unit 28 also has air inlet ports 32 from which fresh air flows into the top of passageway 25. The top construction 12 provides an annular passageway 38 at the bottom of passageway 25, and the fresh air passes therefrom downwardly through a metal tube 40 to the plenum chamber 9 in base 8.

A jet of the gas from valve 20 is directed upwardly into an aspirator unit 44 and the fresh air enters unit 44 through the side ports 46, and a proper mixture of gas and air enters the bottom of the burner through port 16. The regenerative countercurrent flow of the flue gases and fresh air in the flue construction 4 provides high overall efficiency, and the flue gases are reduced in temperature to within a temperature range which is acceptable without special safety precautions. The incoming air is further heated in metal tube 40 so that heated air is supplied to plenum chamber 9. A parabolic reflector 50 (see also FIG. 1) is mounted around a segment of chimney 10 substantially concentric therewith so as to reflect the radiant heat toward the front of the heater. The top construction has an access door or "lid" 51 at the front of the heater.

The top of base 8 and the top construction form with chimney 10 a "sealed combustion" chamber to which the gas-air mixture is supplied at the bottom and from which the flue gases pass at the top. Also, the closed fresh air passageway surrounds the path for the flue gases so as to avoid leakage of flue gases into the heated space. Hence, the entire installation is trouble-free from the standpoint of containing the products of combustion. The construction provides very dependable and efficient gas-air circulation with the flue gases being exhausted due to the chimney effect in flue 24 and with the cold fresh air passing downwardly through passageway 26 with the aid of "cold air shaft" effect. Unit 44 is adjusted to provide the optimum gas-air mixture. That is provided by the simple construction and adjustment because of the preheating of the incoming fuel gas in tube 18. The wide variations in the temperature of fresh air, which normally occur with space heaters, cause difficulties in insuring the proper gas-air ratio for the burner. However, in accordance with the present invention that difficulty is overcome by heating the fresh air and then heating the fuel gas to substantially the temperature of the heated fresh air. The countercurrent heat-exchange relationship between the flue gases and the fresh air insures that warm air is supplied to the burner even at extremely low temperatures, and the preheating of the fuel gas insures against there being an inbalance in the gas-air ratio throughout wide ranges of outside temperatures and operating conditions.

What is claimed is:

1. A space heater comprising a base providing a plenum chamber for fresh air, a chimney mounted upon said base, a top construction closing the top of said chimney and providing an exhaust port for flue gases and a fresh air inlet port for fresh air, a flue construction providing concentric passageways for flue gases and for incoming fresh air connected to discharge flue gases from said exhaust port and to deliver fresh air to said fresh air inlet port, said flue construction providing heat-exchange passageways for heating the incoming fresh air by heat from the flue gases, the construction including means to deliver fresh air from said inlet port to said plenum chamber, a burner positioned within said chimney and having a vertically-disposed heat radiating zone from which heat radiates through said chimney, and means to supply fuel gas to said burner with entrained fresh air from said plenum chamber including a heat-exchange tube within said plenum chamber through which the fuel gas flows to thereby heat the fuel gas to a temperature near the temperature of the fresh air in said plenum chamber.

2. A space heater as described in claim 1 wherein said chimney and said burner are cylindrical and are positioned with substantially concentric vertical axes.

3. A space heater as described in claim 2 which includes a spiral heat-exchange tube positioned within said plenum chamber and through which fuel gas flows to said burner to thereby heat the fuel gas to a temperature near that of the fresh air in the plenum chamber.

4. A space heater as described in claim 3 which includes a metal air-inlet tube extending vertically through said chimney and providing a passageway for fresh air passing to said plenum chamber.

5. A space heater as described in claim 4 which includes a structure surrounding the remote end of said flue construction and shielding said passageways and providing ports for the exhaust of the flue gas and the entry of fresh air.

6. A space heater as described in claim 5 wherein said base and top construction are of greater diameter than said chimney, and tie-bolts extending outside of said chimney between said base and said top construction and hold said base and top construction in substantially gas-tight relationship at the top and bottom edges of said chimney.

7. A space heater as described in claim 6 wherein said burner is a cylindrical infrared burner wall and a top wall.

8. A space heater as described in claim 7 wherein said chimney is infrared-transparent glass.

9. A space heater as described in claim 8 which includes a parabolic reflector at the rear of said chimney to reflect the infrared heat.

10. In a space heater, the combination of, a vertical axis chimney constructed of material which transmits radiant heat, a bottom structure closing the bottom of said chimney, a top structure substantially closing the top of said chimney and having an exhaust port, means securing said bottom and top structures against the respective extremeties of said chimney to thereby form a closed chamber with said exhaust port for the flue gases at the top, an infrared gas burner centrally positioned within said chamber and presenting a radiating surface from which heat is radiated through said chimney with the products of combustion being discharged from said burner into said chamber and thence through said exhaust port, means to provide fresh air to said burner along a flow path which subjects the fresh air to the heating action of the flue gases, means forming a plenum chamber through which the heated fresh air passes to said burner, and means to supply fuel gas to said burner along a heat-exchange path with the fresh air passing to said burner to cause the temperature of the fuel gas to approach that of the fresh air when flowing to said burner.

11. Apparatus as described in claim 10 wherein said chimney is cylindrical and is made of glass, and wherein said bottom structure forms a base which encloses said plenum chamber.

12. Apparatus as described in claim 11 wherein said burner is cylindrical with its axis substantially at the axis of said chimney.

13. Apparatus as described in claim 10 which includes a metal tube extending through said closed chamber and through which the fresh air flows in heat exchange relationship with the flue gases.

14. Apparatus as described in claim 10 which includes a flue construction providing concentric passageways for the flue gases passing upwardly and for the incoming fresh air passing downwardly and providing a heat exchange relationship there between.

15. In a space heater, the combination of, a vertical axis chimney having a heat-radiating wall constructed of material which transmits radiant heat, a bottom structure closing the bottom of said chimney, top structure substantially closing the top of said chimney and having an exhaust port for the flue gases at the top, said top and bottom structures closing the extremeties of said chimney and forming a closed chamber, means rigidly mounting said chimney and said top and bottom structures to form a compact unit, an infrared gas burner positioned within said chamber and presenting a heat-radiating surface from which heat is radiated through said heat-transmitting wall of said chimney with the products of combustion being discharged from said burner into said chamber and thence through an exhaust port, means to provide fresh air to said burner, means forming a plenum chamber through which the heated fresh air passes to said burner, and means to supply fuel gas to said burner along a heat-exchange path with the fresh air passing to said burner to cause the temperature of the fuel gas to approach that of fresh air when flowing to said burner.

16. A space heater comprising, a vertical-axis gas burner having a burner structure of the type through which a combustible mixture of fuel gas and air is discharged while being ignited so as to produce intense heat radiation throughout a heat radiating zone which is exposed radially outwardly with respect to said axis, means forming a closed chamber surrounding said burner and including a vertical wall portion which extends upwardly coextensive with and substantially parallel to said heat-radiating zone, said wall structure being of radiant heat transmitting material whereby radiant heat passes radially outwardly through said wall structure in a uniform manner from said heat-radiating zone and out of said chamber, means to supply a mixture of fuel gas and air in proportions to provide substantially complete combustion without excess oxygen, said means forming said chamber including a base through which said mixture of fuel gas and air is delivered to said inlet port of said burner and a top construction providing an exhaust port for flue gases whereby said chamber provides a flue in which the products of combustion pass upwardly and discharge heat by conduction, said means to supply the mixture of fuel gas and air including means to pass the fuel gas in heat exchange relationship with the air to cause the temperature of the fuel gas to approach that of the fresh air when flowing to the zone where said mixture is produced.

17. A space heater comprising, a substantially cylindrical, vertical axis gas burner structure of the type through which a combustible mixture of fuel gas and air is discharged while being ignited so as to produce intense heat radiation throughout a heat-radiating zone which is exposed radially outwardly with respect to said axis, means forming a substantially cylindrical, closed chamber surrounding said burner and having a substantially common axis with said burner and including a vertical wall portion which extends upwardly coextensive with and substantially parallel to said heat-radiating zone, said wall structure being of radiant heat transmitting material whereby radiant heat passes radially outwardly through said wall structure in a uniform manner from said heat-radiating zone and out of said chamber, means to supply a mixture of fuel gas and air in proportions to provide substantially complete combustion without excess oxygen, said means forming said chamber including a base through which said mixture of fuel gas and air is delivered to said inlet port of said burner and a top construction providing an exhaust port for flue gases whereby said chamber provides a flue in which the products of combustion pass upwardly and discharge heat by conduction.

* * * * *